US009802414B2

(12) United States Patent
Lee

(10) Patent No.: US 9,802,414 B2
(45) Date of Patent: Oct. 31, 2017

(54) ARRAY-TYPE INK CARTRIDGE

(71) Applicant: WOOSIM SYSTEM INC., Seoul (KR)

(72) Inventor: Il Bok Lee, Gyeonggi-do (KR)

(73) Assignee: WOOSIM SYSTEM INC., Seoul (KR)

( * ) Notice: Subject to any disclaimer, the term of this patent is extended or adjusted under 35 U.S.C. 154(b) by 0 days.

(21) Appl. No.: 15/300,423

(22) PCT Filed: Mar. 26, 2015

(86) PCT No.: PCT/KR2015/002971
§ 371 (c)(1),
(2) Date: Sep. 29, 2016

(87) PCT Pub. No.: WO2016/039515
PCT Pub. Date: Mar. 17, 2016

(65) Prior Publication Data

US 2017/0182782 A1 Jun. 29, 2017

(30) Foreign Application Priority Data

Sep. 11, 2014 (KR) ..... 10-2014-0119967

(51) Int. Cl.
*B41J 2/175* (2006.01)
*B41J 2/155* (2006.01)
(Continued)

(52) U.S. Cl.
CPC ..... *B41J 2/17503* (2013.01); *B41J 2/14072* (2013.01); *B41J 2/15* (2013.01);
(Continued)

(58) Field of Classification Search
CPC . B41J 2/14072; B41J 2/15; B41J 2/155; B41J 2/1752; B41J 2/17553;
(Continued)

(56) References Cited

U.S. PATENT DOCUMENTS 5,160,945 A * 11/1992 Drake ..... B41J 2/155 347/42
6,793,319 B2 * 9/2004 Ikemoto ..... B41J 2/1433 347/12
(Continued)

FOREIGN PATENT DOCUMENTS

CN 1347806 A 5/2002
JP 2003-182099 A 7/2003
(Continued)

OTHER PUBLICATIONS

Japanese Patent Abstract (in English) of JP Pub. No. 2003-182099 A, Pub. Date Jul. 3, 2003, downloaded Aug. 2, 2016 from http://www4.j-platpat.inpit.go.jp/eng/.
(Continued)

*Primary Examiner* — Anh T. N. Vo
(74) *Attorney, Agent, or Firm* — Barcelo, Harrison & Walker, LLP

(57) ABSTRACT

The present invention relates to an array-type ink cartridge. The present array-type ink cartridge comprises: a plurality of ink cartridge modules which each have a pair of heads arranged so as to cross each other in the longitudinal direction so that the print width expands; and a fixing plate for fixing the plurality of ink cartridge modules and aligning the fixing position so that the plurality of ink cartridge modules are in an array configuration in the longitudinal direction of the ink cartridge modules or the width direction of the ink cartridges. The array-type ink cartridge according to embodiments of the present invention can embody various colors and print widths of various sizes by using a plurality of ink cartridge modules, and can optionally expand the number of ink cartridge modules used according to the characteristics of a printing device.

6 Claims, 17 Drawing Sheets

(51) Int. Cl.

| | |
|---|---|
| ***B41J 2/515*** | (2006.01) |
| ***B41J 2/14*** | (2006.01) |
| ***B41J 2/15*** | (2006.01) |
| ***B41J 11/42*** | (2006.01) |

(52) U.S. Cl.
CPC ..... *B41J 2/155* (2013.01); *B41J 2/515* (2013.01); *B41J 11/42* (2013.01)

(58) Field of Classification Search
CPC ..... B41J 2/17559; B41J 2/515; B41J 2002/14475; B41J 2002/19; B41J 2002/20; B41J 11/42
See application file for complete search history.

(56) References Cited

U.S. PATENT DOCUMENTS

| | | | | |
|---|---|---|---|---|
| 7,658,470 | B1 | 2/2010 | Jones et al. | |
| 7,857,423 | B2 * | 12/2010 | Suzuki | B41J 2/155 347/12 |
| 8,020,964 | B2 * | 9/2011 | Sugahara | B41J 2/14233 347/40 |
| 8,246,141 | B2 | 8/2012 | Petruchik et al. | |
| 8,550,598 | B2 * | 10/2013 | Owaki | B41J 2/17513 347/42 |
| 9,446,587 | B2 * | 9/2016 | Chen | B41J 2/14072 |
| 2002/0171707 | A1 | 11/2002 | Ara | |
| 2002/0191046 | A1 | 12/2002 | Otsuki | |
| 2007/0064048 | A1 | 3/2007 | Lee et al. | |
| 2007/0291073 | A1 | 12/2007 | Jung et al. | |
| 2009/0002441 | A1 | 1/2009 | Suzuki et al. | |
| 2009/0079790 | A1 | 3/2009 | Mizutani | |
| 2010/0201734 | A1 | 8/2010 | Kuk | |
| 2011/0037808 | A1 | 2/2011 | Ciminelli et al. | |
| 2011/0292126 | A1 | 12/2011 | Nystrom et al. | |
| 2012/0038709 | A1 | 2/2012 | Owaki | |

FOREIGN PATENT DOCUMENTS

| | | | |
|---|---|---|---|
| KR | 20-1999-0020516 | U | 6/1999 |
| KR | 10-2007-0033791 | A | 3/2007 |
| KR | 10-782819 | B1 | 12/2007 |
| KR | 10-0813964 | B1 | 3/2008 |
| KR | 10-2010-0092223 | A | 8/2010 |
| KR | 10-1317783 | B1 | 10/2013 |
| WO | 2012134480 | A1 | 10/2012 |
| WO | 2014133600 | A1 | 9/2014 |

OTHER PUBLICATIONS

Korean Patent Abstract (in English) of KR Pub. No. 10-2007-0033791 A, Pub. Date Mar. 27, 2007, downloaded Sep. 27, 2016 from http://kpa.kipris.or.kr/kpa/.

Korean Patent Abstract (in English) of KR Utility Model Pub. No. 20-1999-0020516 U, Pub. Date Jun. 15, 1999.

Korean Patent Abstract (in English) of KR Pub. No. 10-2010-0092223 A, Pub. Date Aug. 20, 2010, downloaded Aug. 1, 2016 from http://kpa.kipris.or.kr/kpa/.

Korean Patent Abstract (in English) of KR Patent No. 10-0813964 B1, Dated Mar. 10, 2008, downloaded Aug. 1, 2016 from http://patent.ndsl.kr/patDetail.do?cn=KOR1020050088319.

Korean Patent Abstract (in English) of KR Patent No. 10-782819 B1, Dated Dec. 6, 2007, downloaded Aug. 1, 2016 from http://worldwide.espacenet.com/publicationDetail/.

Korean Patent Abstract (in English) of KR Patent No. 10-1317783 B1, Dated Oct. 15, 2013, downloaded Nov. 9, 2016 from http://engpat.kipris.or.kr/engkpa/.

Office Action for CN Patent Application No. 201580027399.5 (Issue No. 2017072101595410), dated Jul. 26, 2017.

Chinese Patent Abstract (in English) of CN Pub. No. 1347806 A, Pub. Date May 8, 2002, downloaded from https://worldwide.espacenet.com/.

International Search Report (in English) from Korean Intellectual Property Office for International Application No. PCT/US2013/068529 dated Feb. 12, 2014.

International Search Report (in English) from Korean intellectual Property Office for international Application No. PCT/US2011/030731 dated Dec. 19, 2011.

* cited by examiner

ARRAY-TYPE INK CARTRIDGE

CROSS-REFERENCE TO RELATED APPLICATIONS

This application is the national stage for International Patent Cooperation Treaty Application PCT/KR2015/002971, filed Mar. 26, 2015, which claims priority from Korean Patent Application No. 10-2014-0119967, filed Sep. 11, 2014, in the Korean Intellectual Property Office. The entire contents of said applications are incorporated herein by reference for all purposes.

BACKGROUND

Technical Field

The present invention relates to an array-type ink cartridge, and more particularly, to an array-type ink cartridge that uses a plurality of ink cartridge modules and is capable of increasing the number of ink cartridge modules being used according to characteristics of a print apparatus.

An ink cartridge is a replaceable component used in a printing apparatus, such as an inkjet printer, and stores ink ejected onto a print medium, such as paper, during printing. The ink cartridge is also referred to as an inkjet cartridge, and has various shapes and sizes based on a print apparatus being used.

Generally, the ink cartridge includes an ink reservoir having one or more partition walls, and may further include an electronic contact and a chip for communicating with the print apparatus according to manufacturers.

A Piezo-method, a heating method, a bubble jet method, or the like is used as an ejecting method of the ink cartridge. The Piezo-method is a method of printing as a Piezo-element vibrates according to an electric signal to push ink outside a nozzle. In the Piezo-method, a relatively big nozzle is used since an amount of ink is adjustable by controlling a current flowing time, and has an advantage in graphic outputs since various sizes of ink droplets are generated and thus small droplets are generated when minute expression is required and big droplets are generated for a large area. However, since the nozzle is large, it is relatively difficult to increase the number of nozzles, and the nozzle is blocked easily.

The heating method and the bubble jet method are similar in that bubbles are generated via heat and ink is ejected according to expansive force of the bubbles, but in the heating method, a heater is provided opposite to a nozzle and in the bubble jet method, a heater is provided below a nozzle.

The heating method and the bubble jet method have similar overall characteristics. Also, in the heating method and the bubble jet method, the numbers of nozzles are easily increased since structures are simple, and the nozzles are not easily blocked even if air bubbles enter the nozzles since the air bubbles are discharged together with ink. However, since only a certain size of ink droplet is ejected per nozzle, minute expression is difficult, and a print speed is low when a large area needs to be printed.

However, in a general ink cartridge, sizes of ink droplets and colors of ink are fixed, and thus different ink cartridges are used for print apparatuses being used.

Also, there is a product that uses an ink cartridge including an array type head corresponding to a width of a print medium such that the ink cartridge does not move back and forth and is fixed and only a print medium is transferred in one direction, but in this case as well, a configuration of the ink cartridge is fixed.

Accordingly, an ink cartridge which is capable of extending a print width or realizing various colors by using several ink cartridge modules and in which the number of ink cartridge modules being used are arbitrarily increased according to characteristics of a print apparatus needs to be considered.

DETAILED DESCRIPTION OF THE INVENTION

Technical Problem

One or more embodiments of the present invention provide an array-type ink cartridge which is capable of extending a print width or realizing various colors by using a plurality of ink cartridge modules, and capable of arbitrarily increasing the number of ink cartridge modules being used.

Technical Solution

According to an aspect of the present invention, there is provided an array-type ink cartridge including: a plurality of ink cartridge modules each including a pair of heads that are misaligned in a length direction such that a print width extends; and a fixing plate fixing the plurality of ink cartridge modules and aligning fixed locations such that the plurality of ink cartridge modules form an array in a length direction or a width direction of the plurality of ink cartridge modules.

The array-type ink cartridge may further include a circuit board combined to one side surface of the plurality of ink cartridge modules forming the array, and including a circuit for controlling the plurality of ink cartridge modules forming the array.

The fixing plate may include a combining hole for fixing the plurality of ink cartridge modules and aligning the fixed locations as a coupling member penetrates through the combining hole, and may include a rib for aligning the fixed locations of the plurality of ink cartridge modules and increasing rigidity with respect to bending or twisting.

Advantageous Effects

According to embodiments of the present invention, it is possible to realize various print widths and various colors according to characteristics of a print apparatus being used by using a plurality of ink cartridge modules. Also, since it is possible to arbitrarily increase the number of ink cartridge modules being used according to the characteristics of the print apparatus being used, wherein the number is increased by using the same ink cartridge modules, manufacturing processes may be simplified and manufacturing costs may be reduced compared to when different ink cartridges are used per print apparatus.

DETAILED DESCRIPTION

Best Mode

Hereinafter, one or more embodiments of the present invention will now be described with reference to accompanying drawings.

Figure 1:
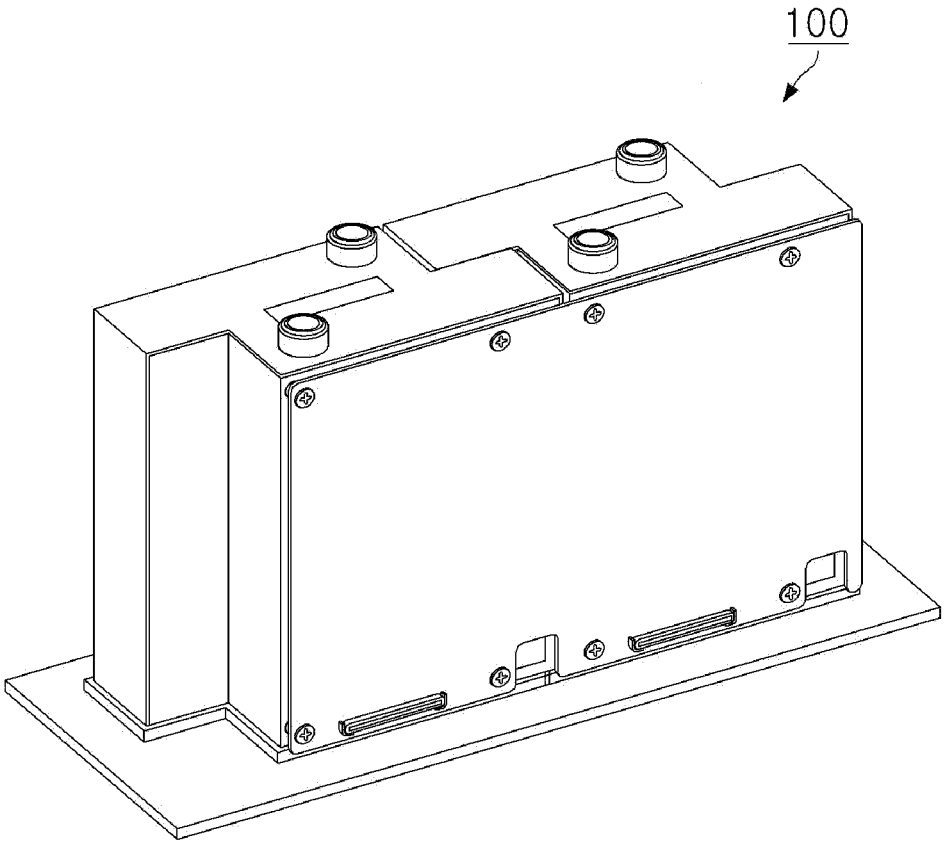
FIG. 1 is a view of an external shape of an array-type ink cartridge according to a first embodiment of the present invention.
Figure 2:
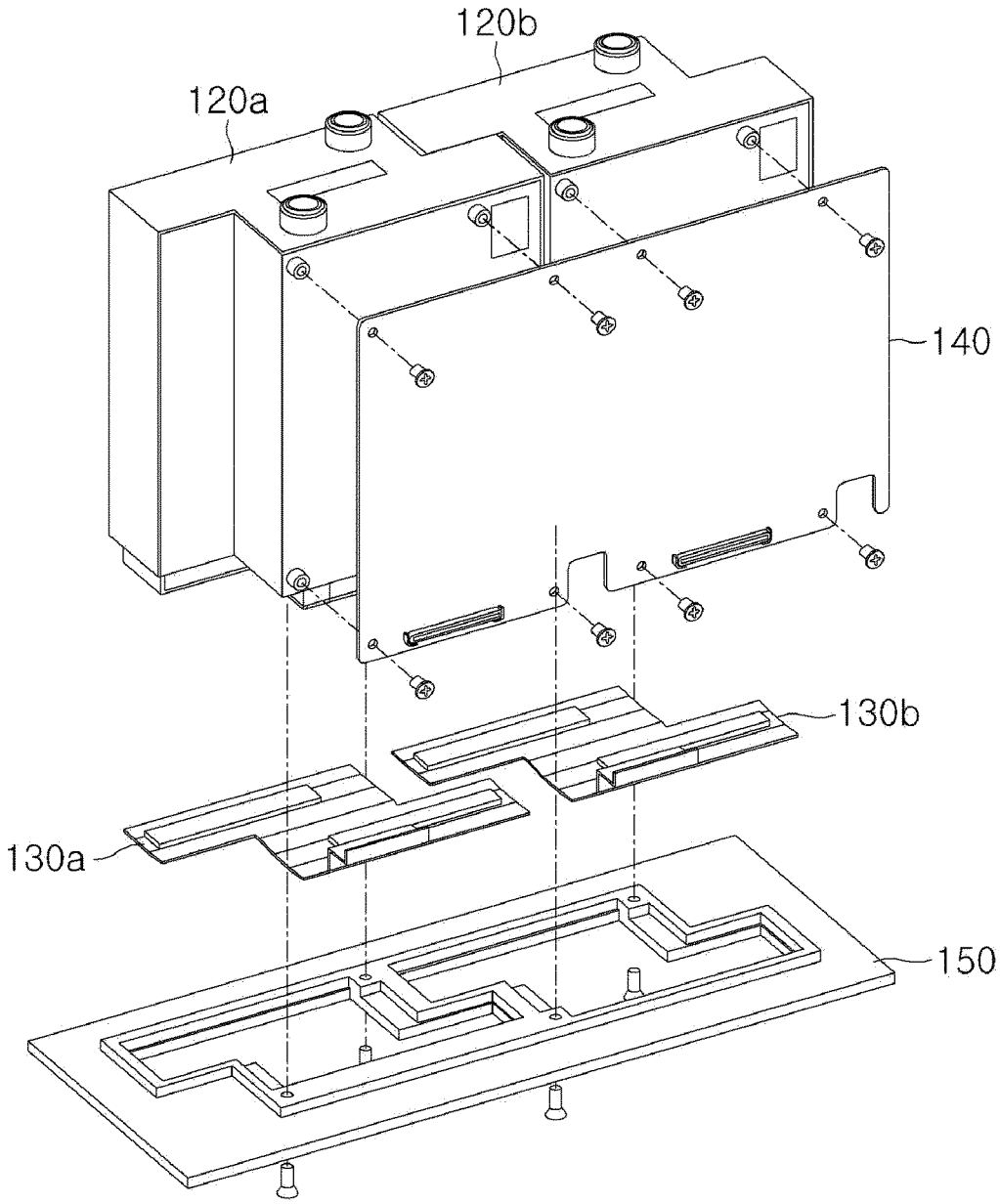
FIG. 2 is an exploded perspective view of the array-type ink cartridge according to the first embodiment of the present invention.
Figure 3:
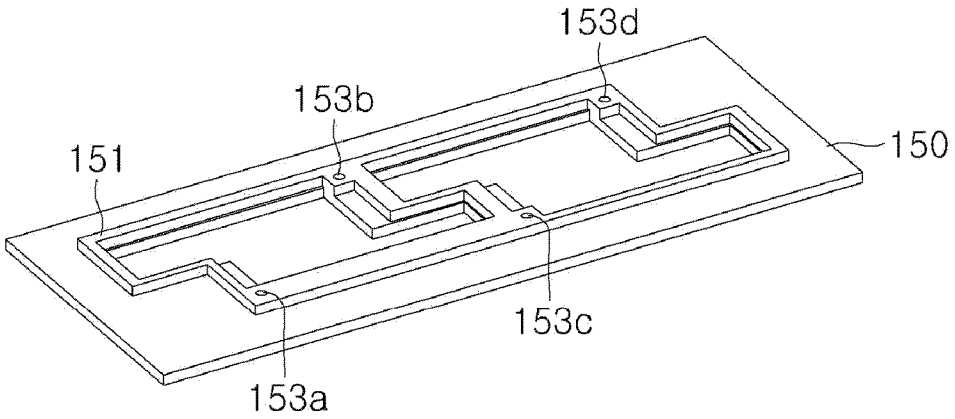
FIG. 3 is a view of a fixing plate of FIG. 2.

FIG. 1 is a view of an external shape of an array-type ink cartridge according to a first embodiment of the present invention, FIG. 2 is an exploded perspective view of the array-type ink cartridge according to the first embodiment of the present invention, and FIG. 3 is a view of a fixing plate of FIG. 2.

Referring to FIGS. 1 through 3, the array-type ink cartridge 100 may include a first ink cartridge module 120*a*, a second ink cartridge module 120*b*, a first flexible printed circuit board 130*a*, a second flexible printed circuit board 130*b*, a circuit board 140, and a fixing plate 150.

The first ink cartridge module 120*a* and the second ink cartridge module 120*b* may each include an ink reservoir for storing ink therein and may each include, at a bottom surface, a pair of heads that are misaligned in a length direction such that a print width extends, thereby ejecting ink through nozzles provided at the heads according to an external control signal. Structures, functions, and shapes of the first ink cartridge module 120*a* and the second ink cartridge module 120*b* are basically the same.

The first ink cartridge module 120*a* and the second ink cartridge module 120*b* have shapes on the plan view, in which two rectangular shapes are misaligned and closely contact each other in a width direction. Here, a rectangular shape does not only mean a geometrically accurate rectangular shape. For example, even if a shape has four corners that are rounded or are partially somewhat protruded or dented, as long as the shape is considered as a rectangular shape, the shape is 'rectangular shape'.

The first and second ink cartridge modules 120*a* and 120*b* may each further include a filter (not shown) for preventing impurities from flowing into the heads or an inlet hole (not shown) that is a passage through which ink that passed through the filter is supplied to the heads. Also, the pair of heads provided at each of the first and second ink cartridge modules 120*a* and 120*b* may be configured to use the same ink reservoir or to use separate ink reservoirs separated according to the heads.

The first flexible printed circuit board 130*a* is connected to the first ink cartridge module 120*a* on a circuit configuration, and may include a chip related to control of the first ink cartridge module 120*a*. Similarly, the second flexible printed circuit board 130*b* is connected to the second ink cartridge module 120*b* on a circuit configuration, and may include a chip related to control of the second ink cartridge module 120*b*.

The circuit board 140 includes a circuit for controlling the first ink cartridge module 120*a* and the second ink cartridge module 120*b*. The circuit board 140 may be combined to one side surface of the first and second ink cartridge modules 120*a* and 120*b*, which form an array in a length direction, by using a coupling member, such as a screw.

Also, the first and second flexible printed circuit board 130*a* and 130*b* may be detachably connected to the circuit board 140 via a connector manner.

The fixing plate 150 fixes the first ink cartridge module 120*a* and the second ink cartridge module 120*b*. As shown in FIG. 3, the fixing plate 150 includes a rib 151 having a shape corresponding to a stepped portion that is stepped inward at the bottom of the first and second ink cartridge modules 120*a* and 120*b*. The rib 151 not only aligns fixed locations such that the first and second ink cartridge modules 120*a* and 120*b* are fixed at certain locations by being combined to the stepped portion formed at the first and second ink cartridge modules 120*a* and 120*b*, but also increases rigidity with respect to bending or twisting, thereby facilitating configuration of an array using several ink cartridges.

The coupling member, such as a screw, is penetrated through the fixing plate 150 to fix the first and second ink cartridge modules 120*a* and 120*b*, and the fixing plate 150 includes combining holes 153*a* through 154*d* for aligning the fixed locations such that the first and second ink cartridge modules 120*a* and 120*b* are fixed at the certain locations. Fixing grooves into which the coupling member is inserted are formed at the bottom surfaces of the first and second ink cartridge modules 120*a* and 120*b*, correspondingly to locations of the combining holes 153*a* through 153*d*.

Figure 4:
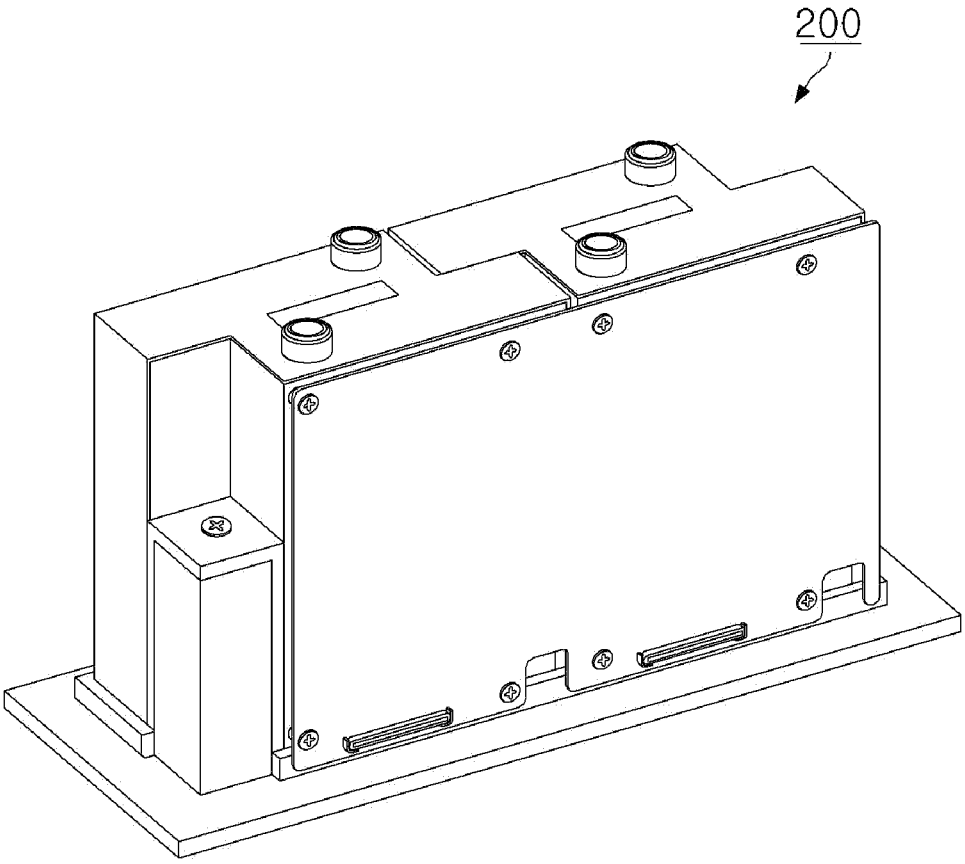
FIG. 4 is a view of an external shape of an array-type ink cartridge according to a second embodiment of the present invention.
Figure 5:
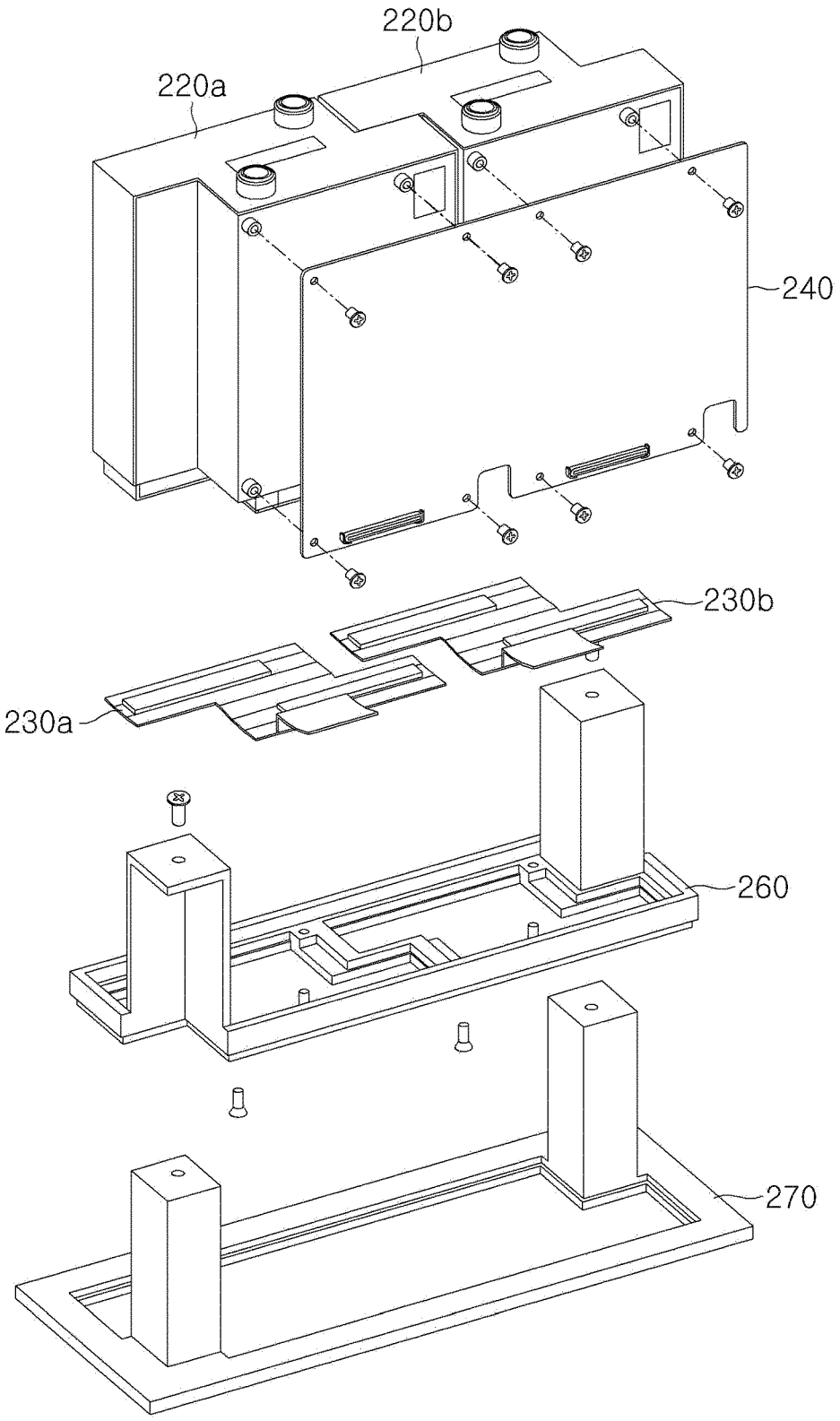
FIG. 5 is an exploded perspective view of the array-type ink cartridge according to the second embodiment of the present invention.
Figure 6:
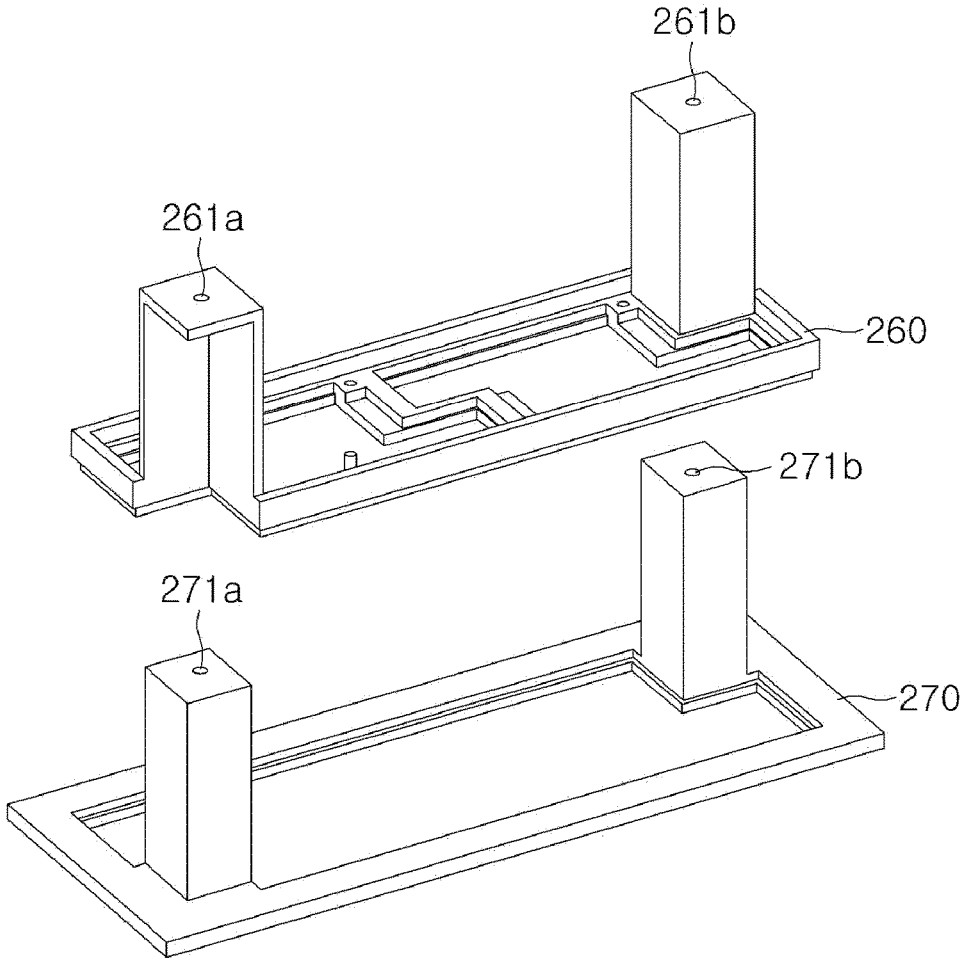
FIG. 6 is a view of a detachable fixing plate and a fixing plate connector of FIG. 5.
Figure 7:
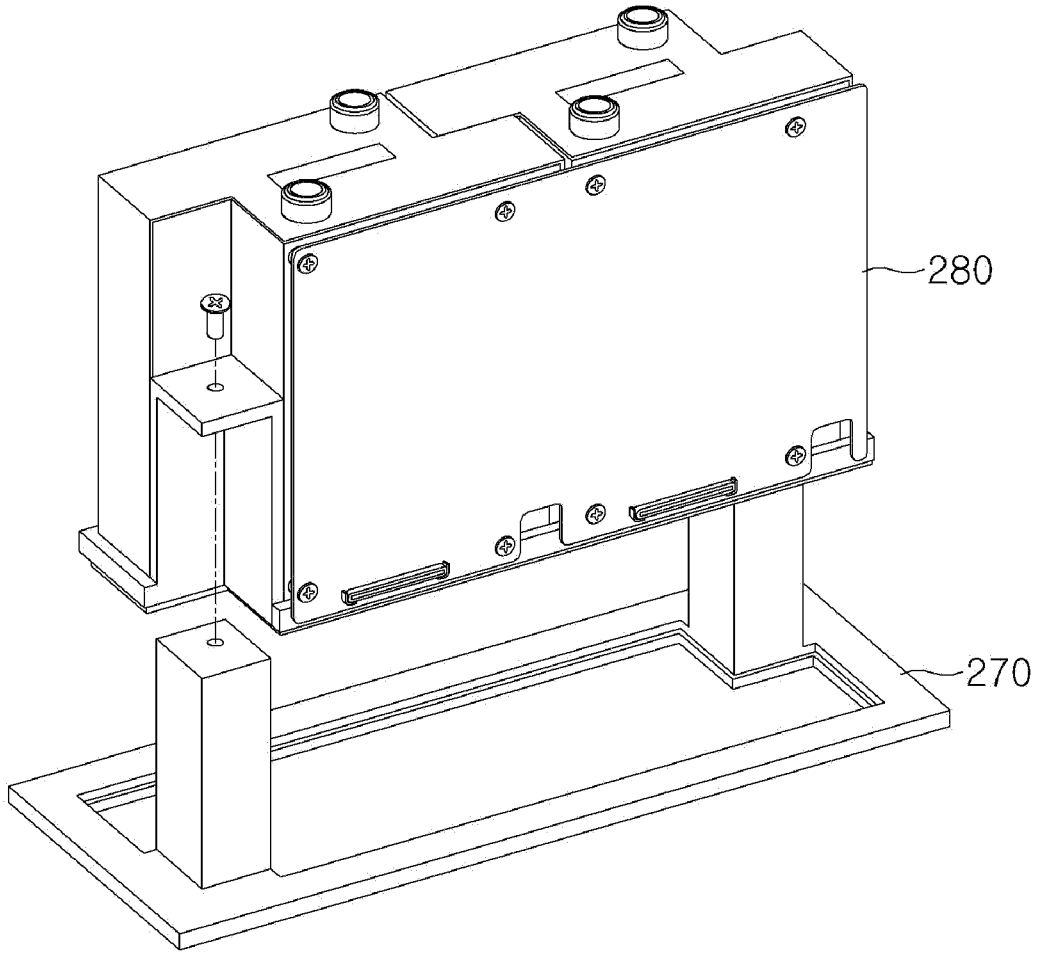
FIG. 7 is a view of an ink cartridge array module and a fixing plate connector.

FIG. 4 is a view of an external shape of an array-type ink cartridge according to a second embodiment of the present invention, FIG. 5 is an exploded perspective view of the array-type ink cartridge according to the second embodiment of the present invention, FIG. 6 is a view of a detachable fixing plate and a fixing plate connector of FIG. 5, and FIG. 7 is a view of an ink cartridge array module and a fixing plate connector.

Referring to FIGS. 4 through 7, the array-type ink cartridge 200 may include a first ink cartridge module 220*a*, a second ink cartridge module 220*b*, a first flexible printed circuit board 230*a*, a second flexible printed circuit board 230*b*, a circuit board 240, a detachable fixing plate 260, and a fixing plate connector 270.

In the array-type ink cartridge 200 according to the current embodiment, the first ink cartridge module 220*a*, the second ink cartridge module 220*b*, the first flexible printed circuit board 230*a*, the second flexible printed circuit board 230*b*, and the circuit board 240 have the same functions and shapes described above in the one or more embodiments.

However, the current embodiment uses the detachable fixing plate 260 that is detachable from a device while the first and second ink cartridge modules 220*a* and 220*b* are fixed, and the fixing plate connector 270 that fixes the detachable fixing plate 260.

As shown in FIG. 6, the fixing plate connector 270 includes thread grooves 271*a* and 271*b* for screw combination with the detachable fixing plate 260, and the detachable fixing plate 260 includes combining holes 261*a* and 261*b* through which screws penetrate.

The fixing plate connector 270 is mounted on a device using the array-type ink cartridge 200, and as shown in FIG. 7, an ink cartridge array module 280, in which the first and second ink cartridge modules 220*a* and 220*b*, the first and second flexible printed circuit boards 230*a* and 230*b*, the circuit board 240, and the detachable fixing plate 260 are combined, may be configured to be detachable from the fixing plate connector 270.

Such a structure facilitates replacement of a certain ink cartridge compared to a case in which the array-type ink cartridge 200 is attached to a print apparatus. In other words, a malfunctioning ink cartridge may be replaced by another ink cartridge module while the ink cartridge array module 280 is separated from the print apparatus.

Figure 8:
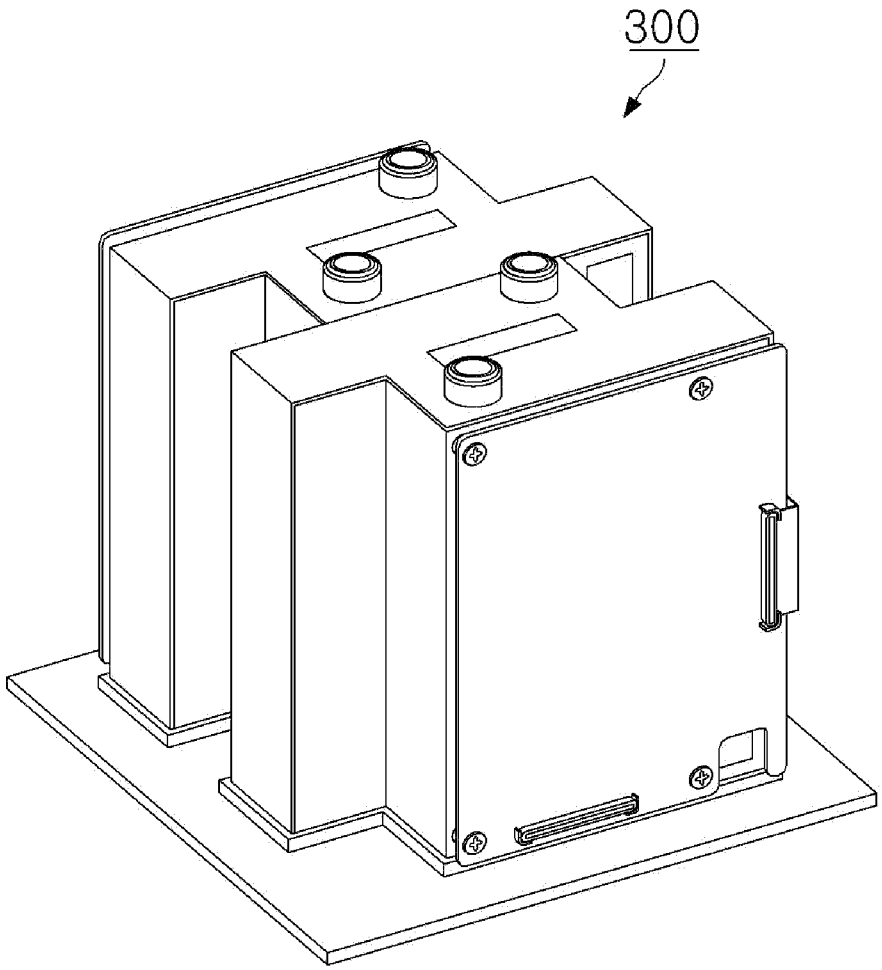
FIG. 8 is a view of an external shape of an array-type ink cartridge according to a third embodiment of the present invention.
Figure 9:
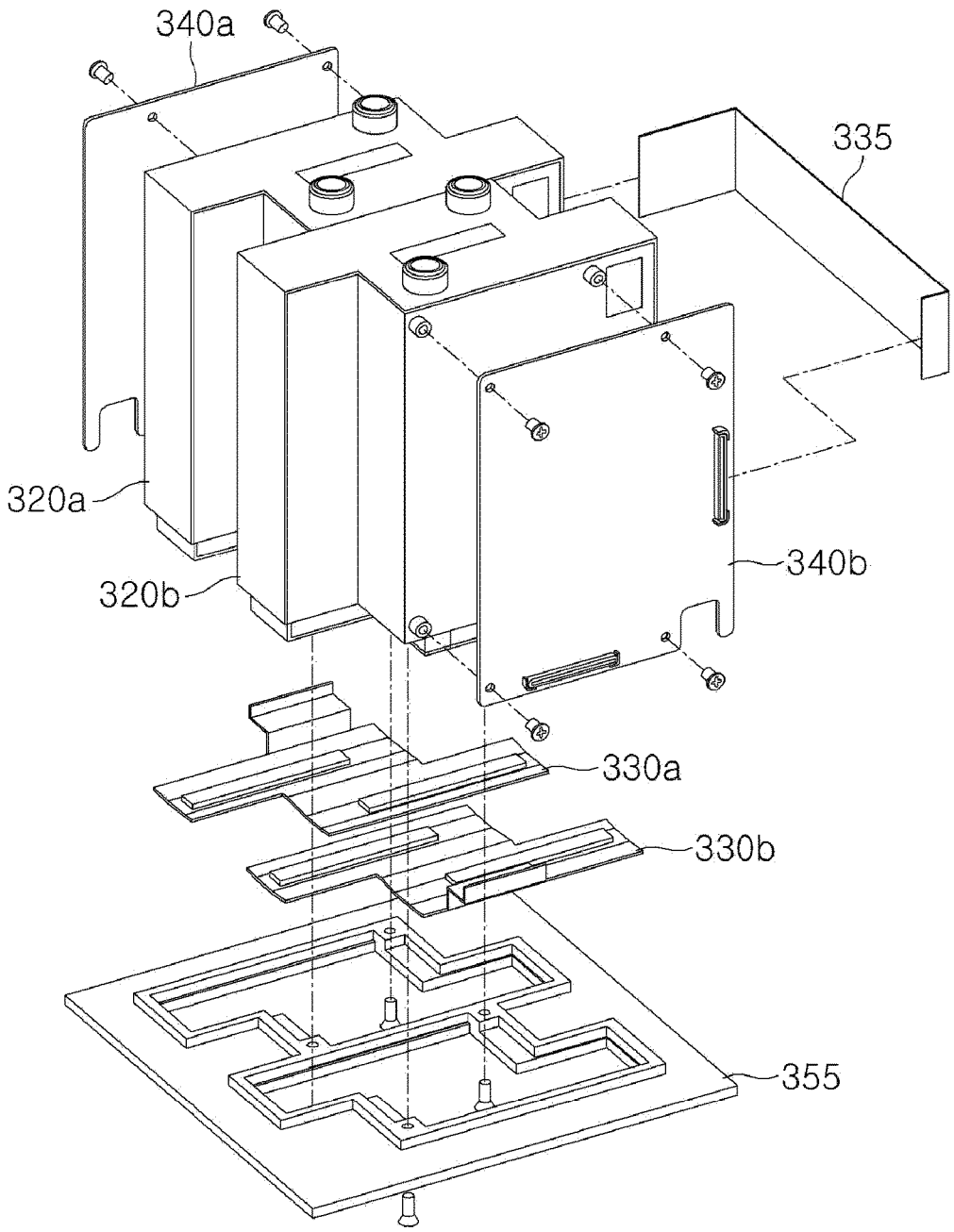
FIG. 9 is an exploded perspective view of the array-type ink cartridge according to the third embodiment of the present invention.

FIG. 8 is a view of an external shape of an array-type ink cartridge according to a third embodiment of the present invention, and FIG. 9 is an exploded perspective view of the array-type ink cartridge according to the third embodiment of the present invention.

Referring to FIGS. 8 and 9, the array-type ink cartridge 300 may include a first ink cartridge module 320*a*, a second ink cartridge module 320*b*, a first flexible printed circuit board 330*a*, a second flexible printed circuit board 330*b*, a third flexible printed circuit board 335, a first circuit board 340*a*, a second circuit board 340*b*, and a fixing plate 355.

In the current embodiment, the first ink cartridge module 320*a*, the second ink cartridge module 320*b*, the first flexible printed circuit board 330*a*, and the second flexible printed circuit board 330*b* have the same functions and shapes described above in the one or more embodiments.

However, in the current embodiment, since the first ink cartridge module 320*a* and the second ink cartridge module 320*b* are arranged in a traverse direction, a shape of the fixing plate 355 differs accordingly.

Also, by using the two circuit boards 340*a* and 340*b*, a circuit for controlling the first ink cartridge module 320*a* is provided on the first circuit board 340*a* and a circuit for controlling the second ink cartridge module 320*b* is provided on the second circuit board 340*b*. Also, the third flexible printed circuit board 355 for connecting the first circuit board 340*a* and the second circuit board 340*b* on a circuit configuration is additionally used.

The array-type ink cartridge 300 having such a shape is usable in an apparatus that requires color printing, by storing different colors of ink in each ink reservoir of the first ink cartridge module 320*a* and the second ink cartridge module 320*b*.

Figure 10:
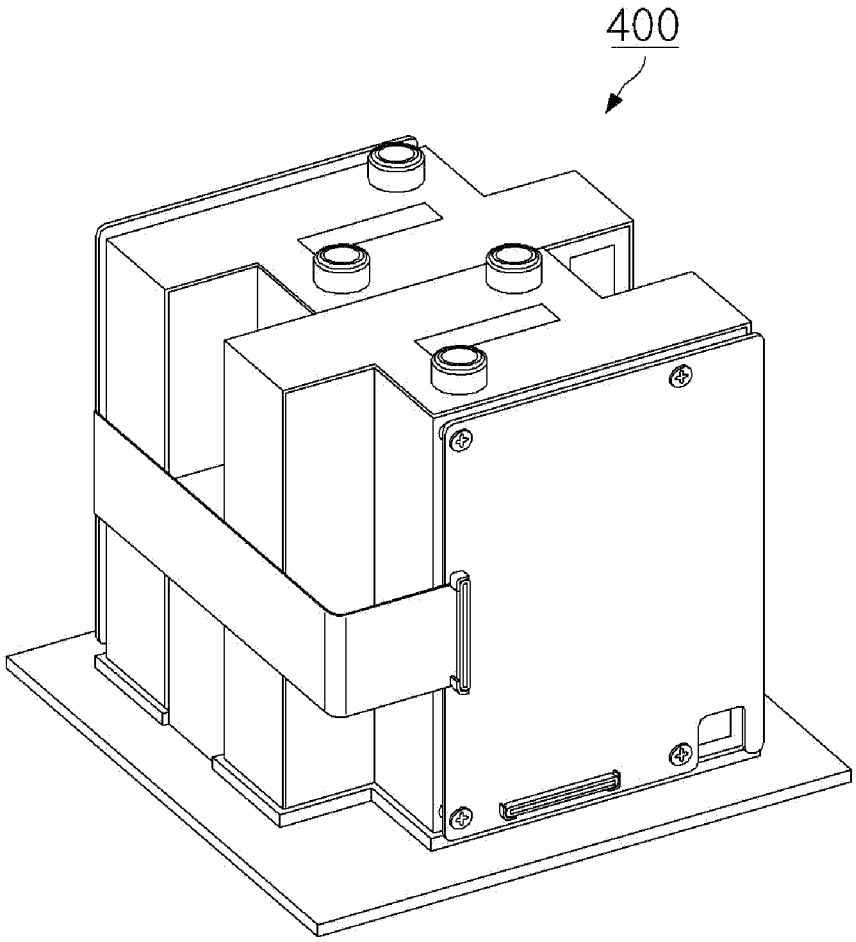
FIG. 10 is a view of an external shape of an array-type ink cartridge according to a fourth embodiment of the present invention.
Figure 11:
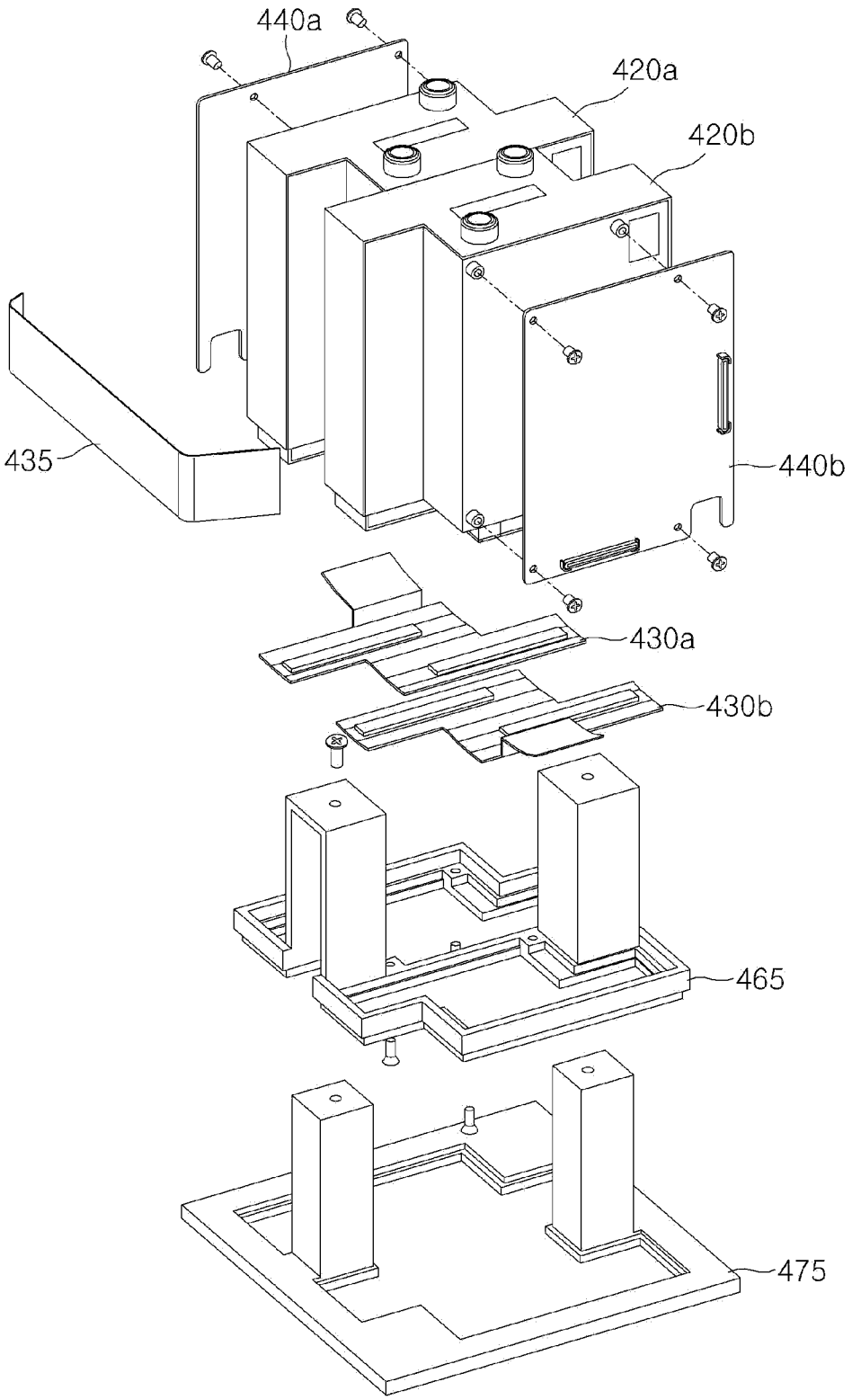
FIG. 11 is an exploded perspective view of the array-type ink cartridge according to the fourth embodiment of the present invention.
Figure 12:
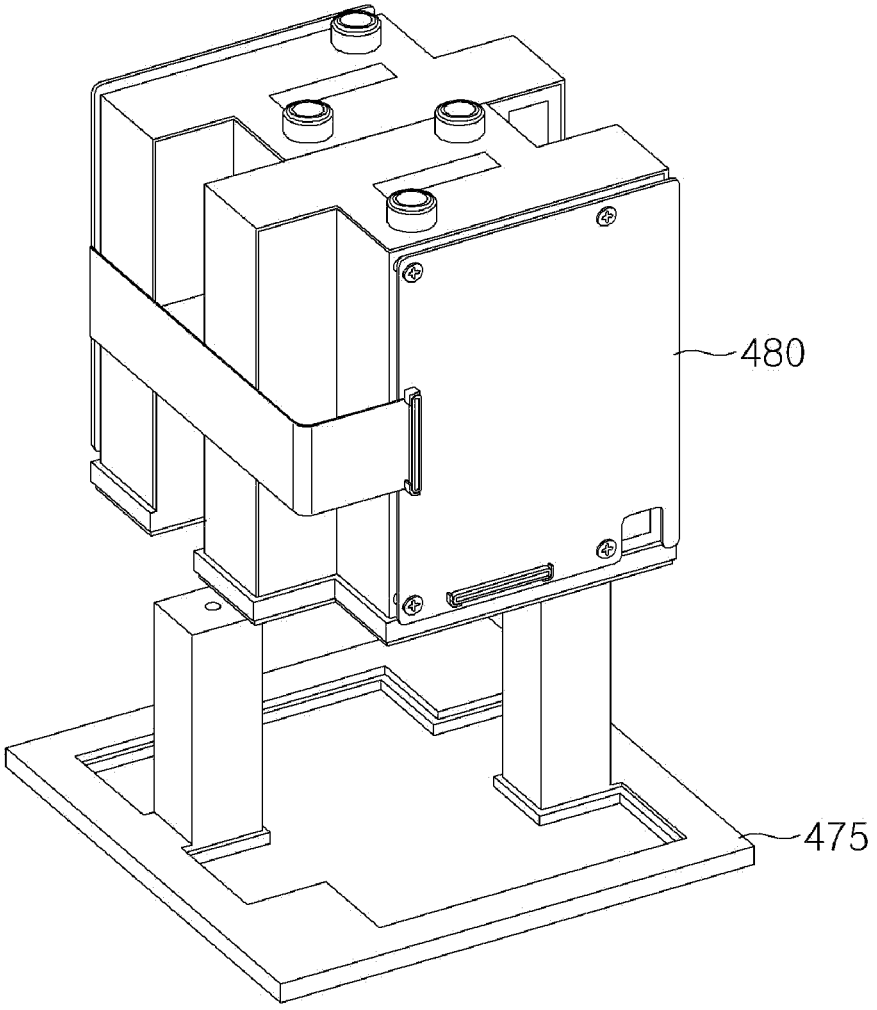
FIG. 12 is a view of an ink cartridge array module and a fixing plate connector of the array-type ink cartridge according to the fourth embodiment of the present invention.

FIG. 10 is a view of an external shape of an array-type ink cartridge according to a fourth embodiment of the present invention, FIG. 11 is an exploded perspective view of the array-type ink cartridge according to the fourth embodiment of the present invention, and FIG. 12 is a view of an ink cartridge array module and a fixing plate connector of the array-type ink cartridge according to the fourth embodiment of the present invention.

Referring to FIGS. 10 through 12, the array-type ink cartridge 400 may include a first ink cartridge module 420*a*, a second ink cartridge module 420*b*, a first flexible printed circuit board 430*a*, a second flexible printed circuit board 430*b*, a third flexible printed circuit board 435, a first circuit board 440*a*, a second circuit board 440*b*, a detachable fixing plate 465, and a fixing plate connector 475.

In the current embodiment, the first ink cartridge module 420*a*, the second ink cartridge module 420*b*, the first flexible printed circuit board 430*a*, the second flexible printed circuit board 430*b*, the third flexible printed circuit board 435, the first circuit board 440*a*, and the second circuit board 440*b* have the same functions and shapes described above in the one or more embodiments.

However, the current embodiment uses the detachable fixing plate 465 that is detachable from a device while the first and second ink cartridge modules 420*a* and 420*b* are fixed, and the fixing plate connector 475 that fixes the detachable fixing plate 260.

Only shapes of the detachable fixing plate 465 and the fixing plate connector 475 are slightly changed according to an arrangement of an ink cartridge module, and the detachable fixing plate 465 and the fixing plate connector 475 basically have the same functions described above with reference to FIGS. 4 through 7.

Accordingly, as shown in FIG. 12, an ink cartridge array module 480, in which the first and second ink cartridge modules 420*a* and 420*b*, the first and second flexible printed circuit boards 430*a* and 430*b*, the third flexible printed circuit board 435, the first and second circuit boards 440*a* and 440*b*, and the detachable fixing plate 260 are combined, may be configured to be detachable from the fixing plate connector 475.

Figure 13:
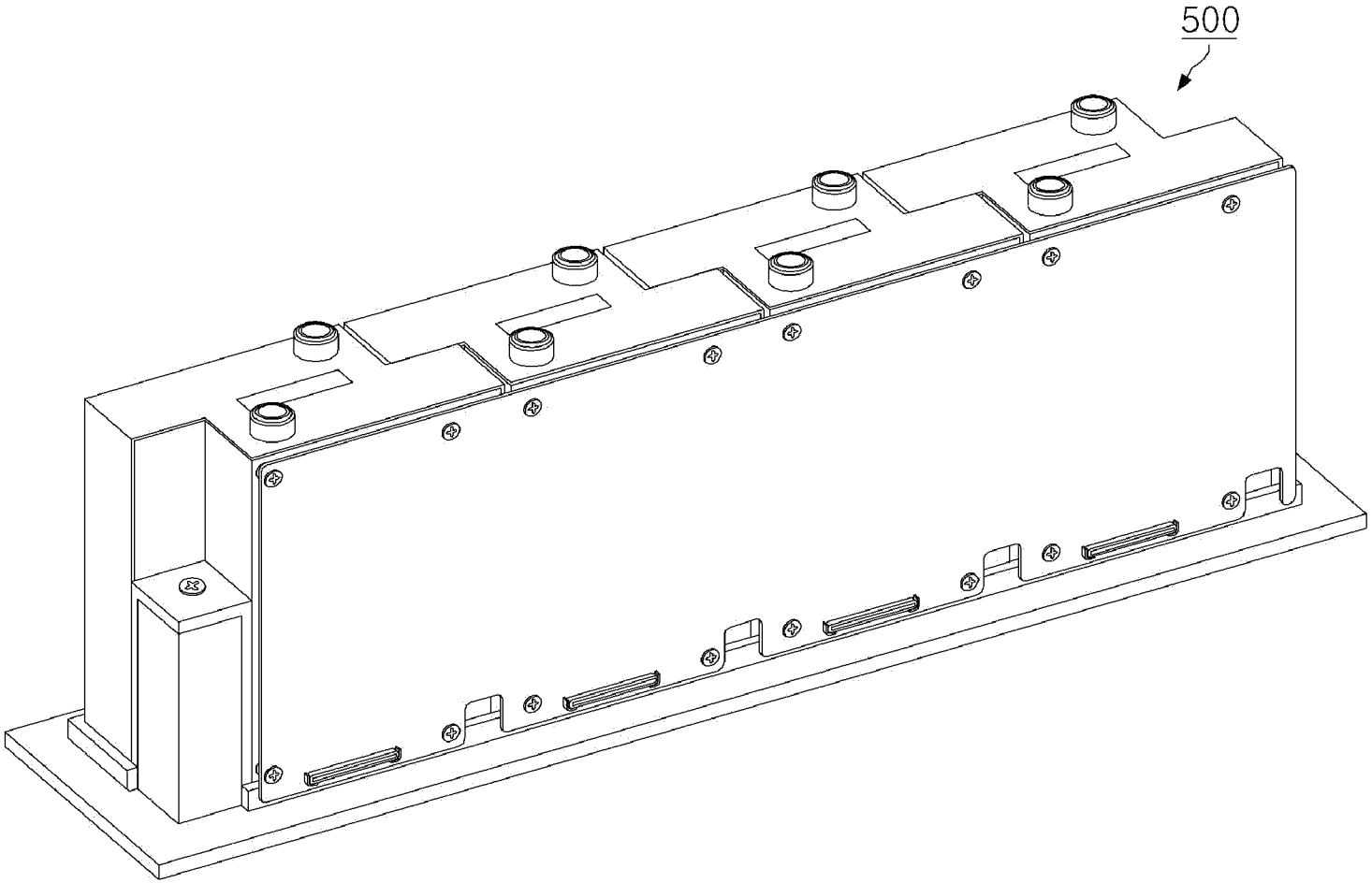
FIG. 13 is a view of an external shape of an array-type ink cartridge according to a fifth embodiment of the present invention.
Figure 14:
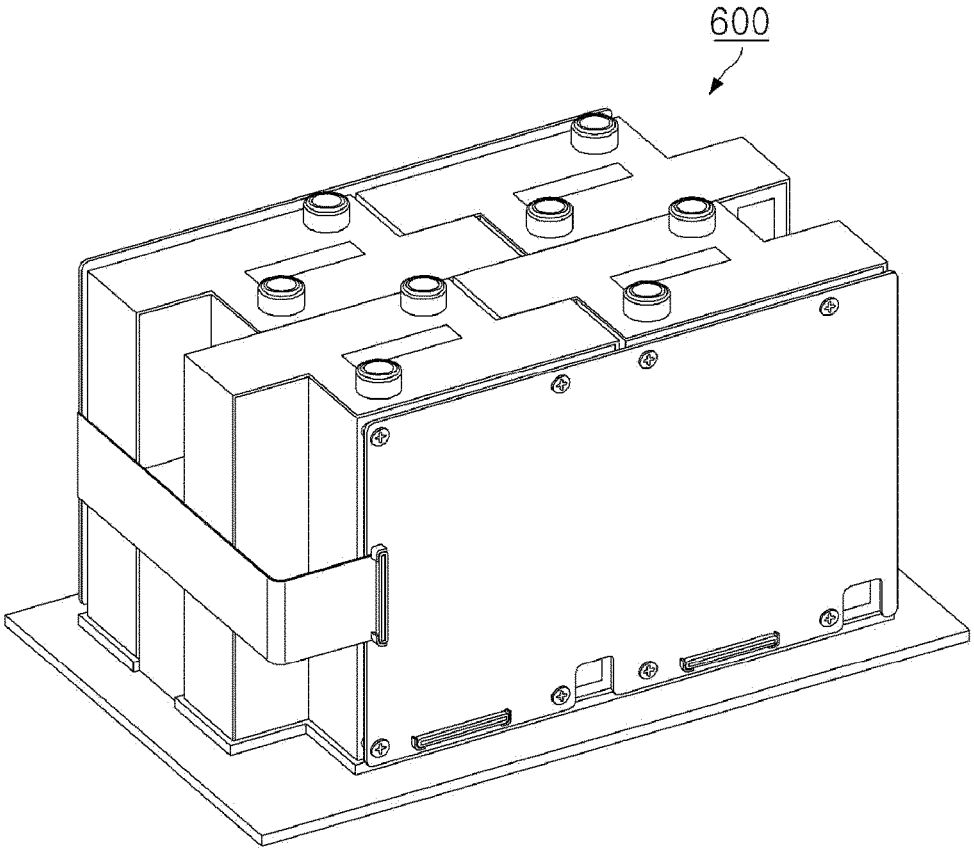
FIG. 14 is a view of an external shape of an array-type ink cartridge according to a sixth embodiment of the present invention.
Figure 15:
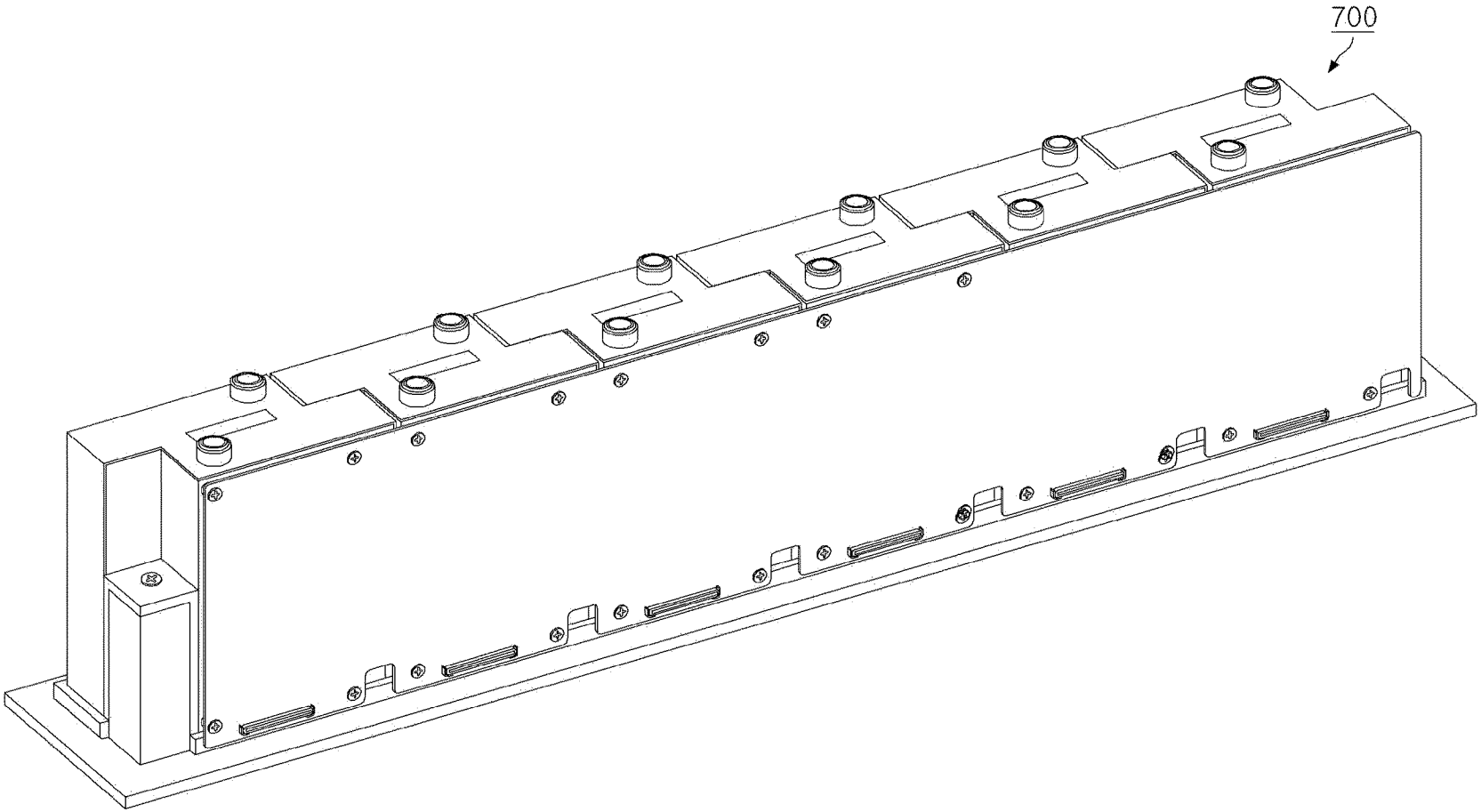
FIG. 15 is a view of an external shape of an array-type ink cartridge according to a seventh embodiment of the present invention.
Figure 16:
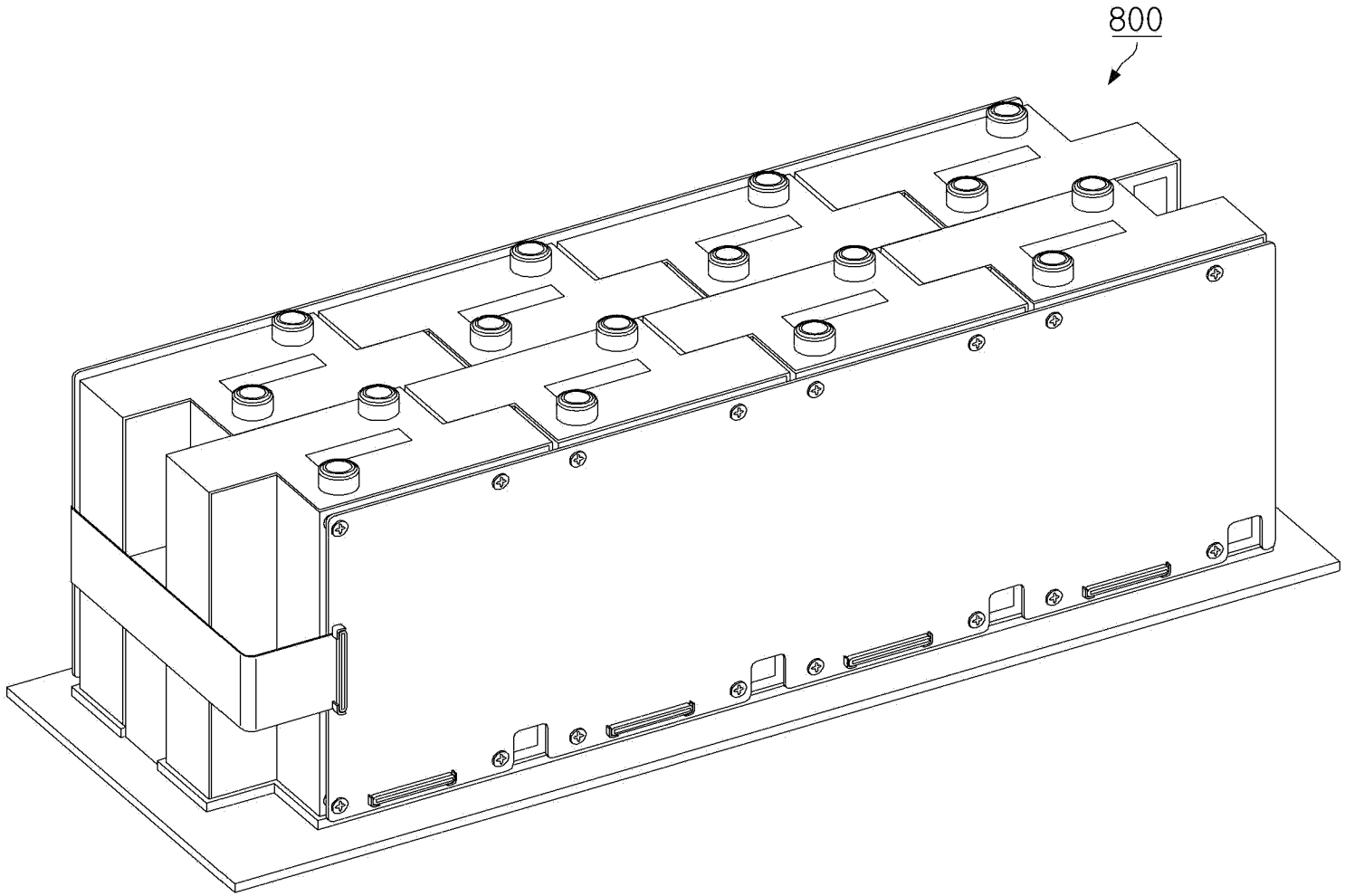
FIG. 16 is a view of an external shape of an array-type ink cartridge according to an eighth embodiment of the present invention.
Figure 17:
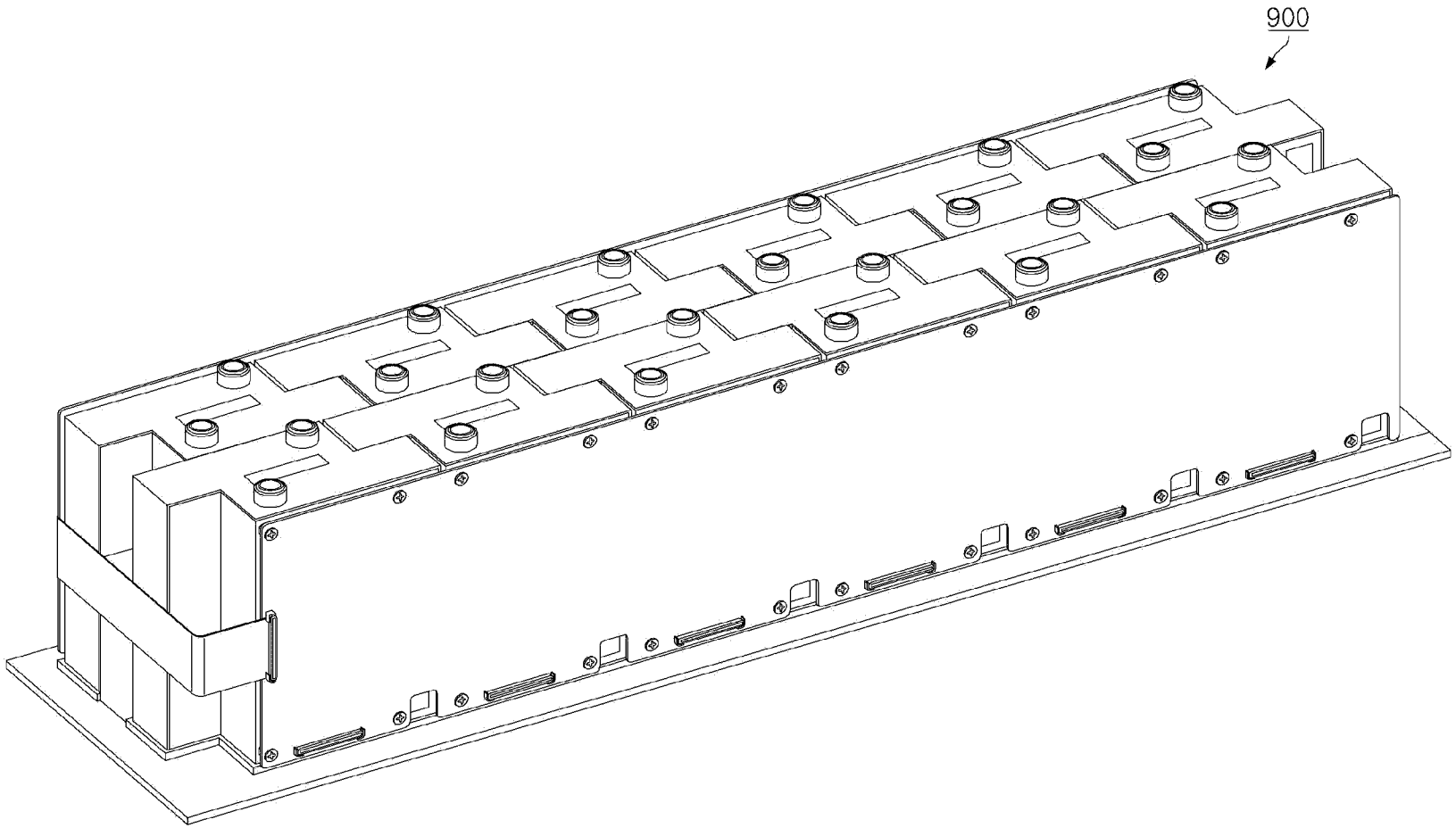
FIG. 17 is a view of an external shape of an array-type ink cartridge according to a ninth embodiment of the present invention.

FIG. 13 is a view of an external shape of an array-type ink cartridge according to a fifth embodiment of the present invention, FIG. 14 is a view of an external shape of an array-type ink cartridge according to a sixth embodiment of the present invention, FIG. 15 is a view of an external shape of an array-type ink cartridge according to a seventh embodiment of the present invention, FIG. 16 is a view of an external shape of an array-type ink cartridge according to an eighth embodiment of the present invention, and FIG. 17 is a view of an external shape of an array-type ink cartridge according to a ninth embodiment of the present invention.

As shown in FIGS. 13 through 17, an array-type ink cartridge may be extended to array-type ink cartridges 500 and 600 using four cartridge modules, an array-type ink cartridge 700 using six ink cartridge modules, an array-type ink cartridge 800 using eight cartridge modules, and an array-type ink cartridge 900 using twelve ink cartridge modules.

As such, the number of ink cartridge modules extendable in a length direction or a width direction is not limited, and may be arbitrarily increased according to characteristics of a print apparatus being used.

Since a desired print width is realized according to extension in a length direction of such an ink cartridge module, a print speed may be increased. Also, when the ink cartridge module is extended in a width direction, ink reservoirs may store ink having colors, such as cyan, magenta, yellow, black, etc., and thus the ink cartridge modules may be used in a color print apparatus.

Also, since the same ink cartridge modules are used to extend the number, manufacturing processes of the ink cartridge may be simplified and manufacturing costs may be reduced compared to when different ink cartridges are manufactured per print apparatus.

Meanwhile, the array-type ink cartridge according to the present invention is not limitedly applied to the embodiments described above, and some or all embodiments may be selectively combined for various modification.

While this invention has been particularly shown and described with reference to embodiments thereof, it will be understood by those of ordinary skill in the art that various changes in form and details may be made therein without departing from the spirit and scope of the invention as defined by the appended claims.

INDUSTRIAL APPLICABILITY

Embodiments of the present invention may be used in an array-type ink cartridge which uses a plurality of ink cartridge modules and is capable of increasing the number of ink cartridge modules being used according to characteristics of a print apparatus.

What is claimed is:

1. An array-type ink cartridge comprising:

a plurality of ink cartridge modules each comprising a pair of heads that are misaligned in a length direction such that a print width extends;

a fixing plate fixing the plurality of ink cartridge modules and aligning fixed locations such that the plurality of ink cartridge modules form an array in a length direction or a width direction of the plurality of ink cartridge modules;

first and second circuit boards respectively combined to one side surface and another side surface of the plurality of ink cartridge modules forming the array and comprising a circuit for controlling the plurality of ink cartridge modules; and a flexible printed circuit board for connecting the first and second circuit boards on a circuit configuration, wherein the fixing plate comprises a rib for aligning the fixed locations of the plurality of ink cartridge modules and increasing rigidity with respect to bending or twisting.

2. The array-type ink cartridge of claim 1, further comprising a circuit board combined to one side surface of the plurality of ink cartridge modules forming the array and comprising a circuit for controlling the plurality of ink cartridge modules forming the array.

3. The array-type ink cartridge of claim 1, wherein the fixing plate comprises a combining hole for fixing the plurality of ink cartridge modules and aligning the fixed locations as a coupling member penetrates through the combining hole.

4. The array-type ink cartridge of claim 1, wherein the fixing plate comprises:

a detachable fixing plate combined to the plurality of ink cartridge modules; and a fixing plate connector detachably combined to the detachable fixing plate and mounted on a print apparatus.

5. An array-type ink cartridge comprising:

a plurality of ink cartridge modules each comprising a pair of heads that are misaligned in a length direction such that a print width extends;

a fixing plate fixing the plurality of ink cartridge modules and aligning fixed locations such that the plurality of ink cartridge modules form an array in a length direction or a width direction of the plurality of ink cartridge modules;

first and second circuit boards respectively combined to one side surface and another side surface of the plurality of ink cartridge modules forming the array and comprising a circuit for controlling the plurality of ink cartridge modules; and a flexible printed circuit board for connecting the first and second circuit boards on a circuit configuration.

6. An array-type ink cartridge comprising:

a plurality of ink cartridge modules each comprising a pair of heads that are misaligned in a length direction such that a print width extends; and a fixing plate fixing the plurality of ink cartridge modules and aligning fixed locations such that the plurality of ink cartridge modules form an array in a length direction or a width direction of the plurality of ink cartridge modules, wherein the fixing plate comprises a rib for aligning the fixed locations of the plurality of ink cartridge modules and increasing rigidity with respect to bending or twisting.

* * * * *